US006398340B1

(12) United States Patent
Lin

(10) Patent No.: US 6,398,340 B1
(45) Date of Patent: Jun. 4, 2002

(54) INK JET SERVICE STATION WITH A WIPER MOVED BY A WIPE SLED

(75) Inventor: Tsung-Te Lin, San-Chung (TW)

(73) Assignee: Acer Communications and Multimedia Inc., Taoyuan (TW)

( * ) Notice: Subject to any disclaimer, the term of this patent is extended or adjusted under 35 U.S.C. 154(b) by 0 days.

(21) Appl. No.: 09/614,568

(22) Filed: Jul. 12, 2000

(51) Int. Cl.[7] ..... B41J 2/165
(52) U.S. Cl. ..... 347/33; 15/256.5
(58) Field of Search ..... 347/33, 32, 24, 347/22; 400/701, 702, 702.1; 15/256.5

(56) References Cited

U.S. PATENT DOCUMENTS 5,432,539 A * 7/1995 Anderson ..... 347/33
5,847,728 A * 12/1998 Lee ..... 347/33
5,966,146 A * 10/1999 Lee ..... 347/33
5,984,450 A * 11/1999 Becker et al. ..... 347/33 X
6,168,257 B1 * 1/2001 Aldrich ..... 347/32

* cited by examiner

*Primary Examiner*—David F. Yockey
(74) *Attorney, Agent, or Firm*—Winston Hsu

(57) ABSTRACT

A printing device has a motor that drives an ink jet print head back and forth along a print track. A service station is installed on one end of the print track, and has a first track, a second track, a slot track, and a wipe sled. The wipe sled slides inside a housing of the service station along the first track, in parallel with the print track. The slot track, which is part of the wipe sled, in diagonal to the print track. The second track, mounted on the housing, is perpendicular to print track. A wiper is mounted on both the slot track and the second track. The relative movement of the slot track with the second track as the wipe sled is pushed backwards forces the wiper into a working position.

16 Claims, 4 Drawing Sheets

INK JET SERVICE STATION WITH A WIPER MOVED BY A WIPE SLED

BACKGROUND OF THE INVENTION

1. Field of the Invention

The present invention relates to an ink jet service station. More specifically, the present invention discloses an ink jet service station that obtains its operating mechanical power from an ink jet print head.

2. Description of the Prior Art

Ink jet printing systems are found in a variety of faxes, printers and other types of office equipment. To ensure the continuous proper operation of an ink jet print head within the ink jet printing system, the ink jet printing system has an ink jet service station. The ink jet service station performs basic head cleaning and capping functions. The ink jet nozzles of the print head are capped when the printing system is not in use. This prevents the nozzles from drying out, and thus becoming clogged. Prior to printing, and at periodic intervals during a printing session, the ink jet nozzles are wiped clean to ensure their performance.

The nozzles of the ink jet print head are preferably not wiped prior to capping because the excess ink on the nozzles helps to ensure that they remain moist. Because of this, it is necessary that the wiping element of the ink jet service station move out of the way of the nozzles when the ink jet print head comes into the station to dock. Only when it undocks, i.e., when the nozzles are uncapped, should the wiping element move into position to wipe the nozzles.

The prior art ink jet service station used its own motor to individually move the wiping and capping elements into their respective active positions. Although this is an effective method, it is also somewhat expensive as it requires an extra motor, as well as the control circuitry and associated torque-transfer mechanisms that mechanically connect the motor to the wiping and capping elements.

SUMMARY OF THE INVENTION

It is therefore a primary objective of this invention to provide an ink jet service station that uses the ink jet print head to move the wiping element into position.

The present invention, briefly summarized, discloses an ink jet service station for a printing device, the printing device having a motor that drives an ink jet print head back and forth along a print track. The service station is installed on one end of the print track, and has a first track, a second track, a slot track, and a wipe sled. The wipe sled slides inside a housing of the service station along the first track, in parallel with the print track. The slot track, which is part of the wipe sled, is diagonal to the print track. The second track, mounted on the housing, is perpendicular to the print track. A wiper is mounted on both the slot track and the second track. The relative movement of the slot track with the second track as the wipe sled is pushed backwards forces the wiper into a working position.

It is an advantage of the present invention that, by simply moving along its print track and engaging with the service station, the ink jet print head provides the power that moves the wiper into the working position. Thus, a second motor devoted exclusively to the ink jet service station is not required, which reduces the overall cost of the printing device.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
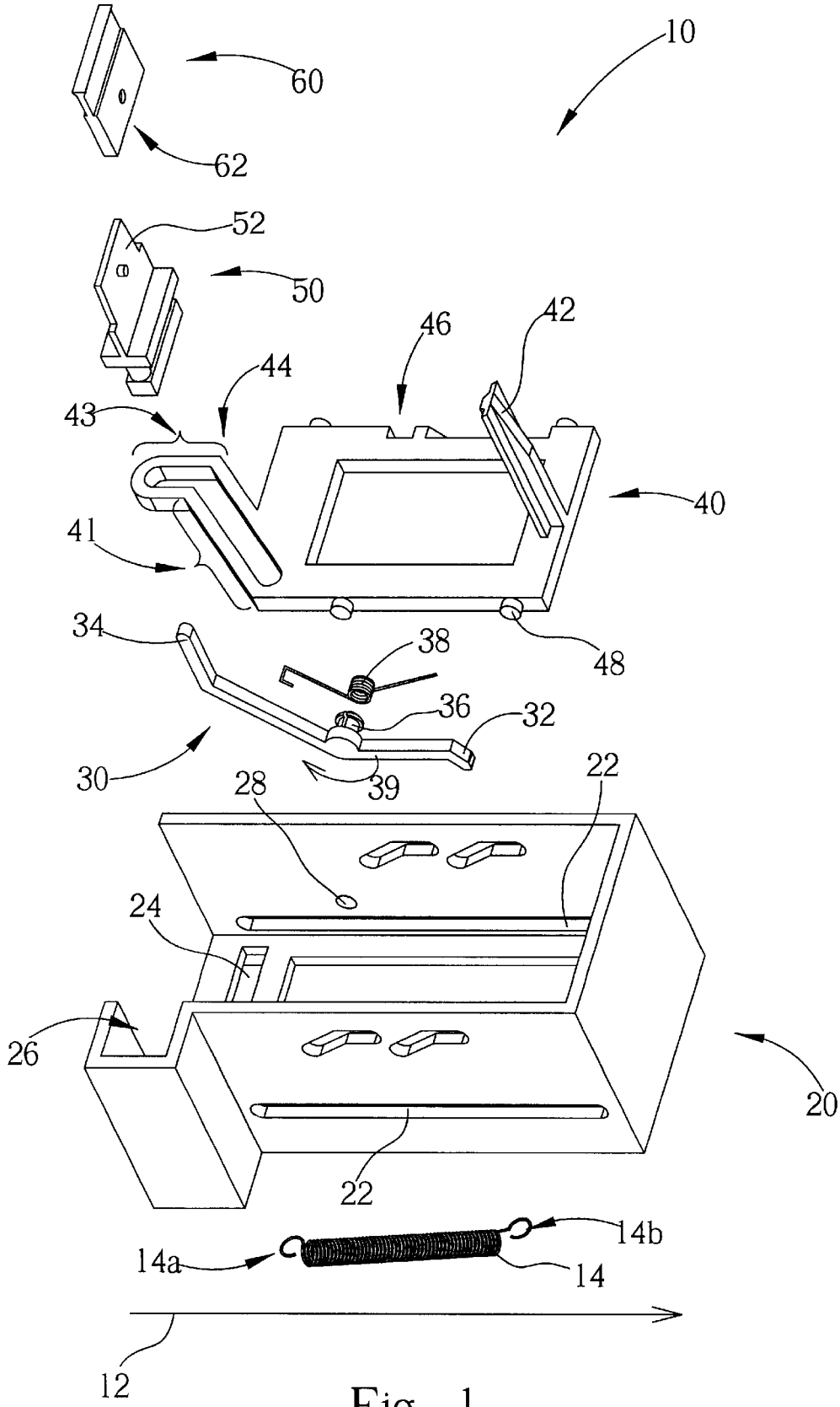
FIG. 1 is an exploded diagram of a preferred embodiment of a present invention ink jet service station.

Please refer to FIG. 1. FIG. 1 is an exploded diagram of a preferred embodiment of a present invention ink jet service station 10. In FIG. 1 of the preferred embodiment, the ink jet service station 10 is installed at a terminating end of a print track. An arrow 12 indicates the forward direction and relative orientation of the print track. A print head (not shown), located in front of the ink jet service station 10, comprises a row of nozzles arranged perpendicular to the print track. The ink jet print head is capable of moving forward and backward along the print track to perform the printing operation. The ink jet print head is driven by a motor (not shown).

The service station 10 comprises a housing 20, a lock bar 30, a wipe sled 40, an elastic element 14, and a wiper 50 with an upper portion 60. The upper portion 60 is made of an elastic material, such as rubber, and is used to wipe nozzles of the ink jet print head. The upper portion 60 is removably connected to the wiper 50, and in this manner can be replaced if it becomes worn or damaged. A tab 52 of the wiper 50 mates with a corresponding niche 62 of the upper portion 60 to lock the two pieces together.

The housing 20 comprises a first track 22, a second track 24, a wiper bay 26 and a lock bar mounting hole 28. The first track 22 lies in parallel with the print track 12, and comprises two slots in the walls of the housing 20. The second track 24 is perpendicular to the first track 22, and is a slot on the bottom of the housing 20. The wiper bay 26 forms a recess in one of the walls of the housing 20, and it is in this recess that the wiper 50 remains when it is not in a working position for wiping the nozzles of the print head.

The lock bar 30 has a locking end 32, an unlocking end 34, a locking axle 36 and a return spring 38. The lock bar 30 is rotatably mounted on the housing 20 using the locking axle 36 and the lock bar mounting hole 28. In this manner, the lock bar 30 pivots about its locking axle 36 on the wall of the housing 20 that has the lock bar mounting hole 28. The locking end 32 engages with the wipe sled 40. The unlocking end 34 engages with the ink jet print head. The return spring 28 is mounted on the locking axle 36 and engages with either end of the lock bar 30 to create a torque 39.

The wipe sled 40 comprises a contact region 42, an aligning region 44, a locking notch 46 and a plurality of pins 48. The pins 48 slidingly engage with the slots of the first track 22. Hence, the wipe sled 40 can slide forward and backward in the housing 20 in reference to the print track 12. The contact region 42 provides a surface against which the print head can push the wipe sled 40 forward in the housing 20. The elastic element 14, a spring in the preferred embodiment, has one end 14*a* connected to the housing 20 and another end 14*b* connected to the wipe sled 40, and thus can pull the wipe sled 40 backwards in reference to the print track 12. The aligning region 44 is a slot track comprising a first slot portion 41 that is diagonal to both the first track 22 and the second track 24, and a second slot portion 43 that is parallel to the first track 22.

The lock bar 30 and the locking notch 46 together form a locking device. When the wipe sled 40 is pushed forward by the print head, the locking end 32 of the lock bar 30 can engage with the locking notch 46. That is, the locking end 32 slips into the locking notch 46. The torque 39 induced by the return spring 38 ensures that the locking end 32 will properly engage with the locking notch 46. In this manner the wiping sled 40 is locked into a forward position, and cannot be pulled backwards by the spring 14. When the print head moves backwards, however, out of the service station 10, a surface on the print head engages with the unlocking end 34 of the lock bar 30. This creates a torque opposite to the torque 39, lifting the unlocking end 32 out of the locking notch 46 and disengaging the lock bar 30 from the locking notch 46, thus unlocking the wipe sled 40. The spring 14 can then pull the wipe sled 40 backward to its home position.

Figure 2:
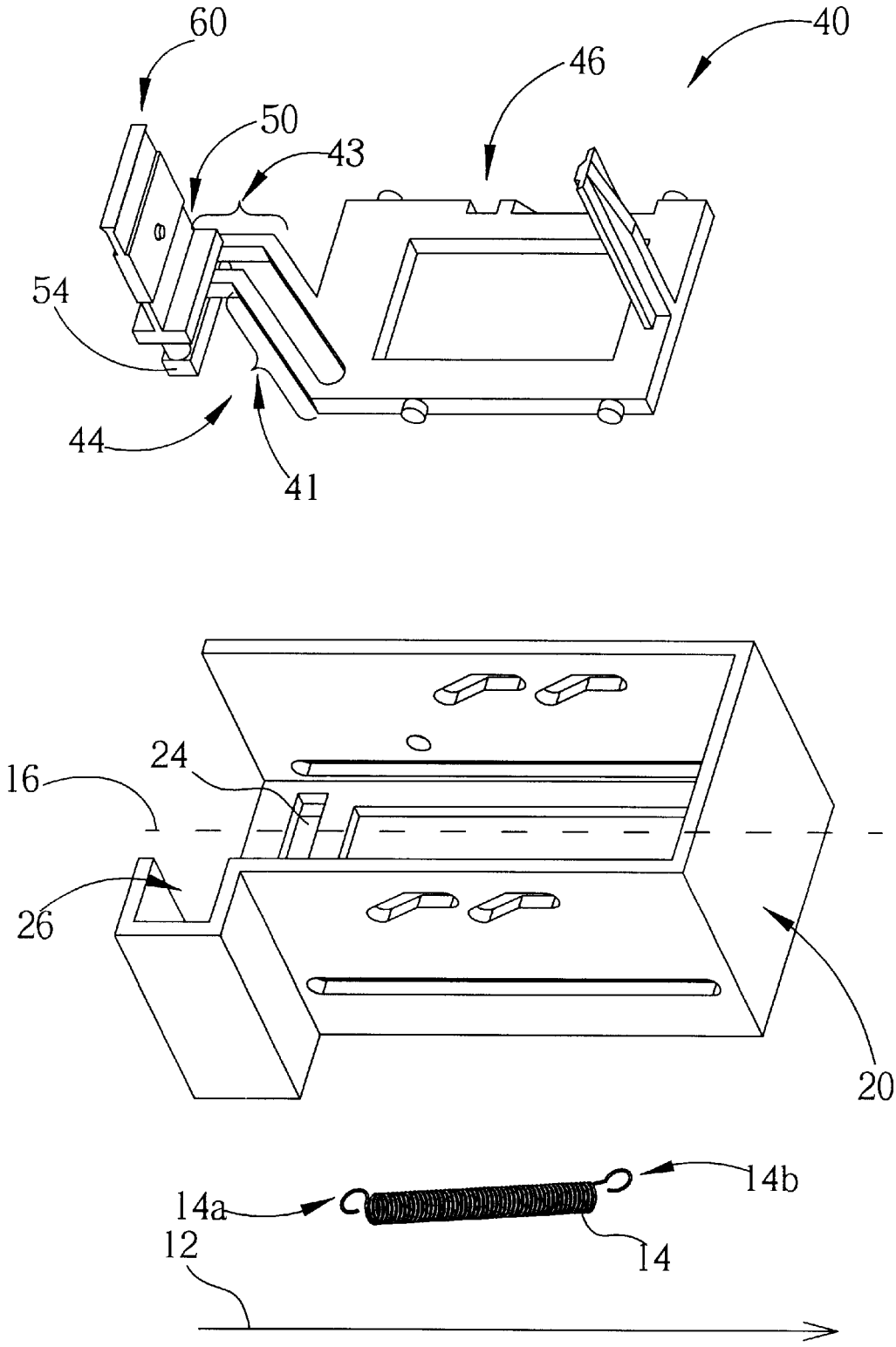
FIG. 2 is a perspective diagram showing a wiper mounted on a wipe sled of the present invention.

Please refer to FIG. 2. FIG. 2 is a perspective diagram showing the wiper 50, and its associated upper portion 60, mounted on the wipe sled 40. The wiper 50 is slidably mounted on the slot track of the aligning region 44. The wiper 50, and its upper portion 60, can slide freely along the first slot portion 41 and the second slot portion 43. However, a bottom rail 54 of the wiper 50 is also slidingly mounted on the second track 24 of the housing 20. Hence, the sliding movement of the wiper 50 is limited by the restraints placed upon it by the aligning region 44 and the second track 24. Consequently, the wiper 50 can only slide along the second track 24 when the wipe sled 40 moves forward or backward in the housing 20. When the wipe sled 40 moves forward in the housing 20, in reference to the print track 12, the diagonal first slot portion 41 of the aligning region 44 pushes the wiper 50 away from the wiper bay 26 along the second track 24. Conversely, when the wipe sled 40 moves backwards, the first slot portion 41 pushes the wiper 50 towards the wiper bay 26.

A working position of the wiper 50 is a position which enables the upper portion 60 of the wipe sled 50 to wipe the nozzles of the ink jet print head, and is indicated in FIG. 2 by the dotted line 16. When the print head pushes the contact region 42 of the wipe sled 40, the wipe sled 40 is pushed forward against the pull of the spring 14. The first slot portion 41 of the aligning region 44 pushes the wiper 50 out of the wiper bay 26 towards the working position 16 along the second track 24. The farther forward the wipe sled 50 is pushed the closer towards the working position 16 the wiper 50 becomes. Finally, the wiper 50 reaches the working position 16. At this point it slides along the second slot portion 43 of the aligning region 44. The second slot portion 43 does not move the wiper 50 any more along the second track 24, as it is perpendicular to the second track 24, but instead keeps the wiper 50 securely placed in the working position 16. The lock bar 30 (shown in FIG. 1) then engages with the locking notch 46, locking the wipe sled 40 into a forward position. Because the wipe sled 40 is locked into the forward position, the wiper 50, with its upper portion 60, is locked into the working position 16. When the print head moves backwards out of the service station 10, its nozzles are wiped by the upper portion 60 of the wiper 50. Continuing to back out, the print head pushes against the unlocking end 34 of the lock bar 30, which unlocks the wipe sled 40. The spring 14 pulls the wipe sled 40 back towards its home position. Doing so causes the wiper 50 to move back towards the wiper bay 26. When the wipe sled 40 reaches its home position, the wiper 50 comes to rest within the wiper bay 26.

Figure 3:
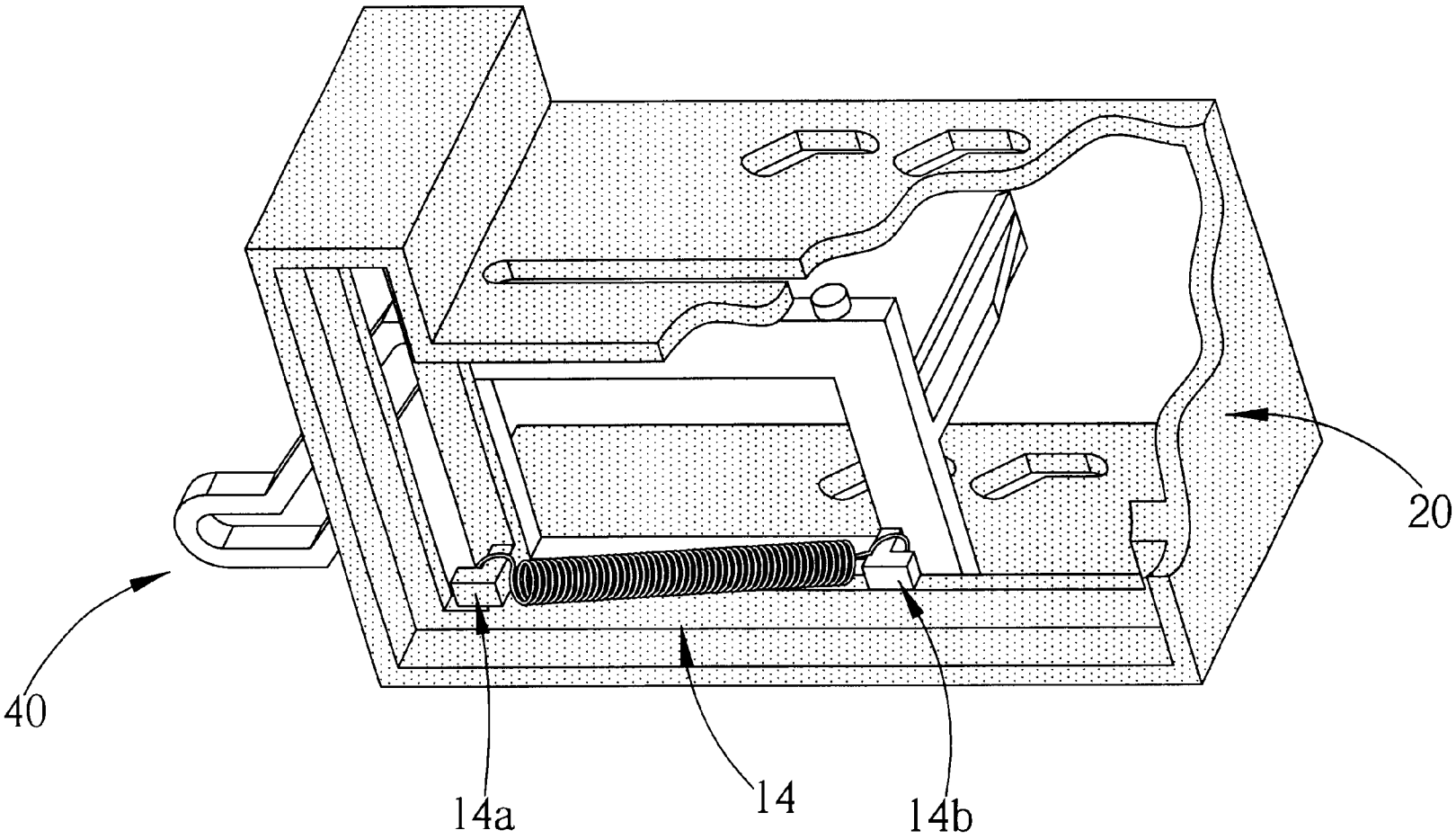
FIG. 3. is a bottom perspective view of a present invention service station.

Please refer to FIG. 3. FIG. 3 is a bottom perspective view of the present invention service station 10. FIG. 3 illustrates how the wipe sled 40 is slidingly mounted within the housing, and how the end 14*a* of the spring 14 is connected to the housing 20 and the other end 14*b* of the spring 14 is connected to the wipe sled 40. It is clear from FIG. 3 that the spring 14 will pull the wipe sled 40 backwards to its home position.

Figure 4:
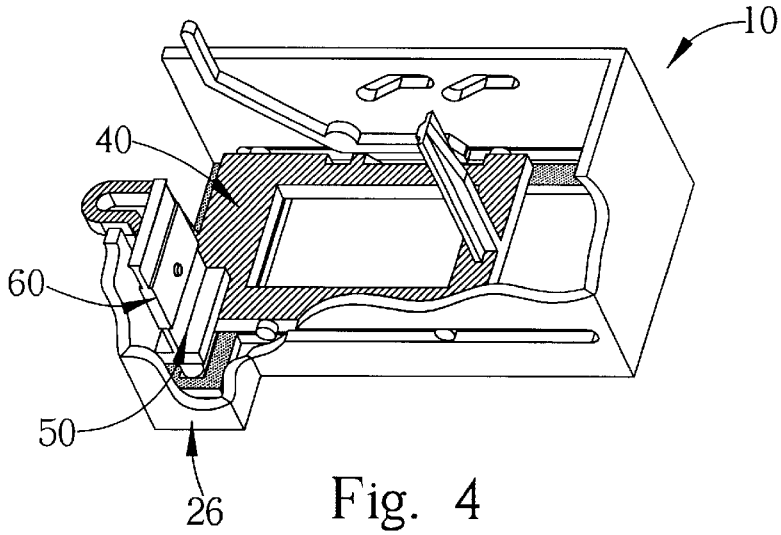
FIG. 4 to FIG. 6 are perspective diagrams of different positions of a present invention wipe sled.
Figure 5:
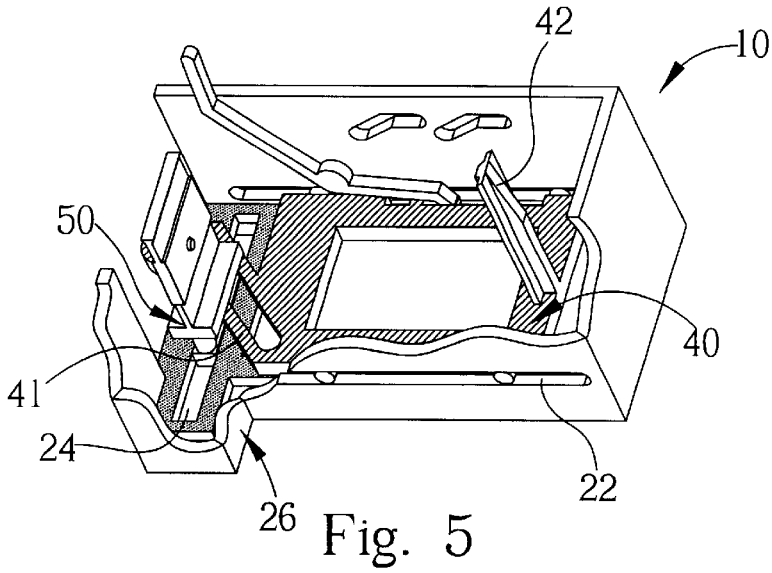
Figure 6:
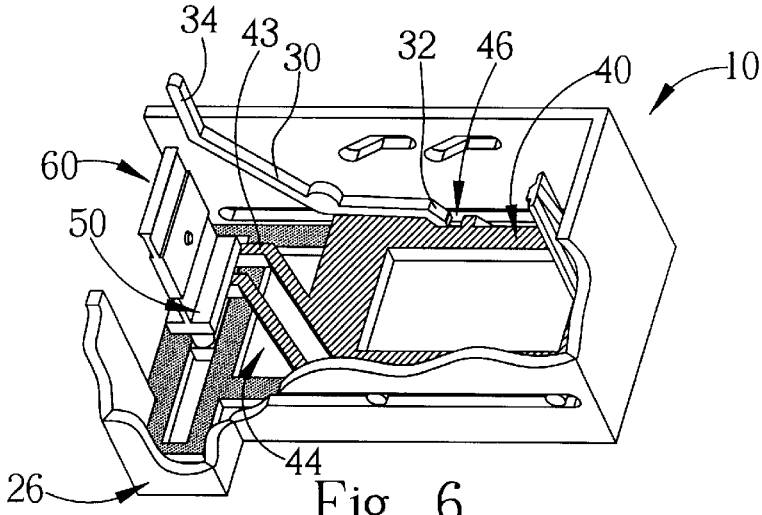

Please refer to FIG. 4 to FIG. 6. FIG. 4 to FIG. 6 are perspective diagrams of different positions of the wipe sled 40 and their corresponding positions of the wiper 50. FIG. 4 depicts the wipe sled 40 in its home position. In this position, the wiper 50 is recessed within the wiper bay 26. Consequently, when the print head moves forward into the service station 10, the nozzles of the print head will not be wiped by the upper portion 60 of the wiper 50.

As shown in FIG. 5, when the wipe sled 40 is pushed forward along the first track 22 by the ink jet print head, the relative movement of the first slot portion 41 with the second track 24 causes the wiper 50 to move out of the wiper bay 26 towards the working position 16 (as indicated in FIG. 2). The spring 14 (as shown in FIG. 3) begins to elongate, and tries to pull the wipe sled 40 backwards. The print head continues to push the wipe sled 40 forward by the contact region 42.

As shown in FIG. 6, when the wipe sled 40 has been pushed fully forward, the wiper 50 is in the working position 16. The wiper 50 is held securely in the working position 16 (as indicated in FIG. 2) by the second slot portion 43 of the aligning region 44. Furthermore, the wipe sled 40 is held in position against the spring 14 (as shown in FIG. 3) by the lock bar 30. The locking end 32 engages with the locking notch 46, and thus prevents the wipe sled 40 from moving backwards. Consequently, when the print head moves backwards out of the service station 10, the wipe sled 40 remains in its forward position, and thus the wiper 50 and the upper portion 60 remain in the working position 16. Hence, as the print head backs up, the nozzles of the print head are wiped by the upper portion 60. Continuing backwards, the print head pushes against the unlocking end 34 of the lock bar 30, causing the locking end 32 to disengage from the locking notch 46. Freed, the wipe sled 40 is pulled backwards by the spring 14. The wipe sled returns to its home position, causing the wiper 50 to move into the wiper bay 26.

It should be noted that the ink jet service station 10 of the present invention also comprises a cap for covering the nozzles of the print head. The cap is not shown in any of the diagrams so as to simplify viewing and understanding of the wiping mechanism. Nevertheless, a cap is preferred as it helps to prevent the nozzles from drying out during extended idle periods when no printing is being performed.

In contrast to the prior art, the present invention uses the ink jet print head to move the wiper into and out of position, and so does not need a separate motor and associated mechanisms to move the wiper into a working position. The present invention has a wipe sled mounted in the housing of the service station, and the wipe sled slides forwards and backwards. The relative movement of the wipe sled with the housing forces a wiper to slide from a bay into a working position after the nozzles have entered the service station. A simple locking device keeps the wipe sled, and thus the wiper, in position. The nozzles are wiped when the in ink jet print head leaves the service station, and, after wiping, the print head unlocks the locking device, causing the sled to return to a home position. This causes the wiper to move back into the bay where it cannot engage with the nozzles of the print head.

Those skilled in the art will readily observe that numerous modifications and alterations of the device may be made while retaining the teachings of the invention. For example, the present invention could also apply to other types of service stations for cleaning the nozzles of a liquid jetting head. In such cases, the operation of the service station is similar to the above description and thus will not be described herein. Accordingly, the above disclosure should be construed as limited only by the metes and bounds of the appended claims.

What is claimed is:

1. An ink jet service station for servicing a print head of a printing device, the print head being capable of moving back and forth along a print track to perform a printing operation, the print head comprising a nozzle, the service station being located at one end of the print track and comprising:

a first track installed on at least a wall of a housing of the service station, the first track arranged in parallel with the print track;

a second track installed on a bottom portion of the housing the second track arranged perpendicular to the first track;

a wipe sled slidably installed in the first track and capable of engaging with the print head, the wipe sled having a contact region and an aligning region; and a wiper slidably mounted on both the second track and the aligning region for wiping ink on the nozzle;

wherein when the print head moves across the service station, the print head engages the contact region of the wipe sled to move the wipe sled forward, and the aligning region of the wipe sled moves the wiper along the second track until the wiper reaches a working position for wiping the nozzle.

2. The service station of claim 1, wherein the aligning region of the wipe sled comprises a slot track, the slot track having a first slot portion diagonal to the directions of the first and second tracks, and the wiper is mounted on the second track through the slot track; wherein when the wipe sled moves, the wiper moves along both the second track and the slot track.

3. The service station of claim 2, wherein the slot track of the wipe sled further comprises a second slot portion parallel to the first track, the second slot portion corresponding to the working position of the wiper; wherein the wiper slidingly engages with the second slot portion when the wiper is in the working position.

4. The service station of claim 1, further comprising a locking device with a lock bar rotatably mounted on the housing and a locking notch on the wipe sled, the lock bar having a locking end and an unlocking end; wherein after the wipe sled moves forward and the wiper reaches the working position, the locking end of the lock bar engages with the locking notch on the wipe sled to lock the wipe sled into position, and when the print head backs out of the ink jet service station, the print head engages with the unlocking end of the lock bar, creating a torque that causes the locking end of the lock bar to disengage from the locking notch and thus unlock the wipe sled.

5. The service station of claim 4, further comprising an elastic element; wherein when the when the wipe sled is unlocked, the elastic element pulls the wipe sled backwards, thus moving the wiper out of the working position.

6. The service station of claim 5, wherein the housing further comprises a wiper bay; wherein when the elastic element pulls the wipe sled backwards, the wiper is recessed within the wiper bay.

7. The service station of claim 1, wherein an upper portion of the wiper comprises an elastic material for wiping the nozzles of the ink jet print head.

8. The service station of claim 7, wherein the elastic material is removably connected to a lower portion of the wiper.

9. A printing system comprising an ink jet print service station comprising: head capable of moving back and forth along a print track to perform a printing operation, and a service station for cleaning a nozzle of the ink jet print head, the service station comprising:

a first track installed on at least a wall of a housing of the service station, the first track arranged in parallel with the print track;

a second track installed on a bottom portion of the housing, the second track arranged perpendicular to the first track;

a wipe sled slidably installed in the first track and capable of engaging with the ink jet print head, the wipe sled having a contact region and an aligning region; and a wiper slidably mounted on both the second track and the aligning region for wiping ink on the nozzle;

wherein when the ink jet print head moves across the service station, the ink jet print head engages the contact region of the wipe sled to move the wipe sled forward, and the aligning region of the wipe sled moves the wiper along the second track until the wiper reaches a working position for wiping the nozzle.

10. The printing system of claim 9, wherein the ink jet print head comprises a row of nozzles arranged perpendicular to the print track.

11. The printing system of claim 9, wherein the aligning region of the wipe sled comprises a slot track, the slot track having a first slot portion diagonal to the directions of the first and second tracks, and the wiper is mounted on the second track through the slot track; wherein when the wipe sled moves, the wiper moves along both the second track and the slot track.

12. The printing system of claim 11, wherein the slot track of the wipe sled further comprises a second slot portion parallel to the first track, the second slot portion corresponding to the working position of the wiper; wherein the wiper slidingly engages with the second slot portion when the wiper is in the working position.

13. A service station for servicing a liquid jetting head, the liquid jetting head being capable of moving back and forth along a routine track to perform a liquid jetting operation, the liquid jetting head comprising a nozzle, the service station being located at one end of the routine track and comprising:

a first track installed on at least a wall of housing of the service station, the first track arranged in parallel with the routine track;

a second track installed on a bottom portion of the housing, the second track arranged perpendicular to the first track;

a wipe sled slidably installed in the first track capable of engaging with the liquid jetting head, the wipe sled having a contact region and an aligning region; and a wiper slidably mounted on both the second track and the aligning region for wiping liquid on the nozzle;

wherein when the liquid jetting head moves across the service station, the liquid jetting head engages the contact region of the wipe sled to move the wipe sled forward, and the aligning region of the wipe sled moves the wiper along the second track until the wiper reaches a working position for wiping the nozzle.

14. The service station of claim 13, wherein the liquid jetting head comprises a row of nozzles arranged perpendicular to the routine track.

15. The service station of claim 13, wherein the aligning region of the wipe sled comprises a slot track, the slot track having a first slot portion diagonal to the directions of the first and second tracks, and the wiper is mounted on the second track through the slot track; wherein when the wipe sled moves, the wiper moves along both the second track and the slot track.

16. The service station of claim 15, wherein the slot track of the wipe sled further comprises a second slot portion parallel to the first track, the second slot portion corresponding to the working position of the wiper; wherein the wiper slidingly engages with the second slot portion when the wiper is in the working position.

* * * * *